United States Patent [19]

de Groot

[11] 4,167,820

[45] Sep. 18, 1979

[54] ELECTRIC HAIR DRYER

[75] Inventor: Johannes de Groot, Hoorn, Netherlands

[73] Assignee: Indola Cosmetics B.V., Netherlands

[21] Appl. No.: 870,768

[22] Filed: Jan. 19, 1978

[51] Int. Cl.[2] ..... F26B 9/00

[52] U.S. Cl. ..... 34/48; 34/97; 132/7; 219/222; 219/364

[58] Field of Search ..... 219/222, 364, 509; 132/7, 9; 128/1 B, 2 H, 399, 402; 34/48, 97, 98, 99, 100, 101

[56] References Cited

U.S. PATENT DOCUMENTS

| | | | |
|---|---|---|---|
| 3,426,441 | 2/1969 | Broski | 34/99 |
| 3,920,000 | 11/1975 | Atherton | 128/1 B |
| 4,085,309 | 4/1978 | Godel et al. | 34/48 |
| 4,088,869 | 5/1978 | Nopanen | 34/97 |

FOREIGN PATENT DOCUMENTS

| | | | |
|---|---|---|---|
| 2429657 | 1/1975 | Fed. Rep. of Germany | 132/9 |

*Primary Examiner*—John J. Camby
*Assistant Examiner*—Larry I. Schwartz
*Attorney, Agent, or Firm*—Hopgood, Calimafde, Kalil, Blaustein & Lieberman

[57] ABSTRACT

An electric hair dryer includes a heating source and a heating element to produce a supply of heated hair. The heating element is connected to a regulating element which is also connected to a temperature probe placed in the hair. By means of this arrangement, heat is supplied to the hair in varying amounts so as to maintain the hair temperature at a substantially constant level.

3 Claims, 2 Drawing Figures

ELECTRIC HAIR DRYER

Figure 1:
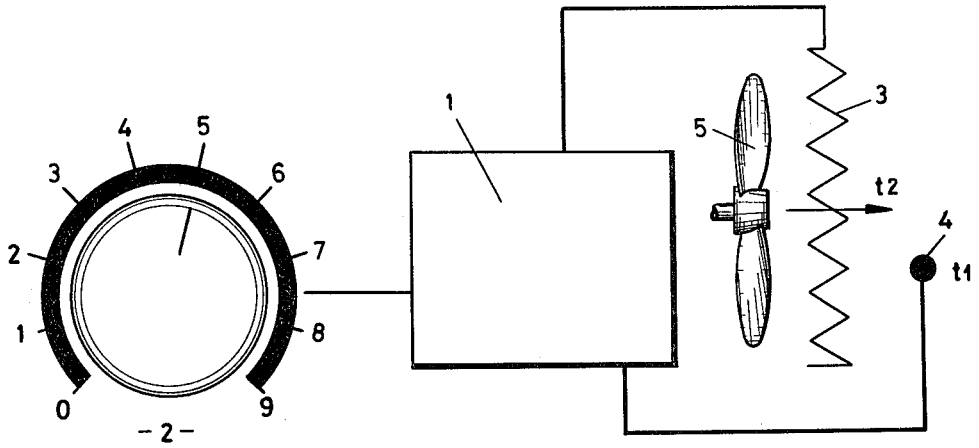

The invention relates to an electric hair dryer including a heating source for a fan and a heating element. The known hair dryer of this type has the disadvantage that the operator has to carefully monitor the time necessary for drying the person's hair, and that air of varying temperatures is blown over the person's head.

It is the object of the invention to provide an electric hair dryer of above-mentioned type in which these disadvantages have been removed.

According to the invention an electric hair dryer is provided in which a temperature measuring probe connected to a regulating module is connected in the heating source power supply line and is provided with an adjusting means.

In a preferred embodiment the regulating module is connected in the line for supplying adjustable power to the heating means.

By the invention the temperature in the person's hair is measured and the measured value controls the heating means through the regulating module so that the hair temperature remains at the value adjusted by the operator and consequently remains constant.

This automatic process control which is preferably achieved by an electronic adjusting module, is based on the principle that in the beginning of the drying process the supplied air temperature is optimally high, but as the hair becomes dryer the temperature will fall until the hair is dry or almost dry, whereas during the drying process the temperature on the head skin remains constant or almost constant. The end of the drying process is signalled at the moment the supply of heat is switched off. Consequently the timing of the drying procedure required in the prior art can be omitted.

The invention provides the advantage that the drying process passes as quickly as possible and also provides optimum comfort for the person whose hair is being dried.

Figure 2:
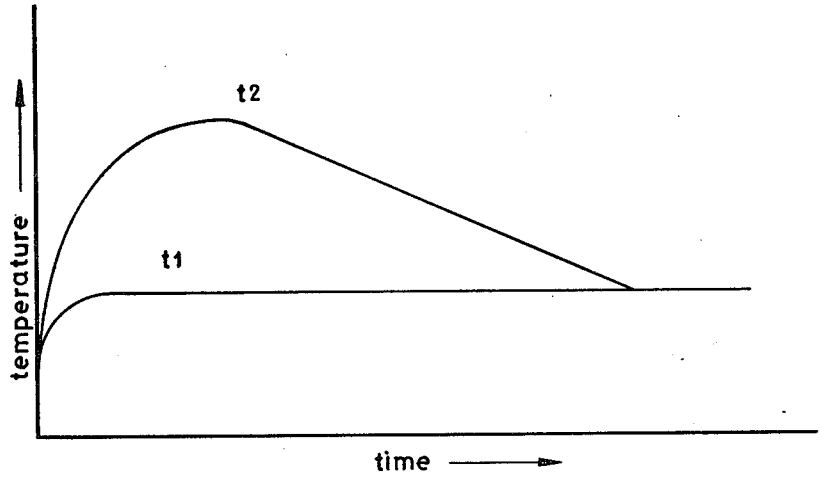

The invention is described in the specification and the drawing in which:

FIG. 1 is a circuit diagram of an electric hair dryer according to the invention; and FIG. 2 is a temperature curve of the drying process employing the electric hair dryer according to the invention.

Referring to FIG. 1 the electric hair dryer according to the invention is provided with a heating source consisting of a heating element 3 and a fan 5. An adjusting element including an adjusting knob 2 is connected in the power supply line to the heating element. The heating element is provided with at least one measuring probe 4 connected to an adjusting module 1 which, in turn, is connected in the power supply line between adjusting knob 2 and heating element 3.

In operation, before beginning the drying process, the temperature measuring probe 4 is positioned in the hair to be treated. The probe 4 measures the temperature of the head hair and by feedback coupling through the electronic adjusting module 1 to the electric heating element 3, the probe ensures that the temperature at the head remains at the adjusted value and consequently remains constant. This value of head hair temperature has been adjusted previously within certain limits by the operator, and depends on the person to be treated.

The heated air to the hair will cool to a certain extent depending on the amount of moisture in the hair. The heated air will cool more as the hair contains more moisture. Since the hair contains the most moisture at the beginning of the drying process the temperature of the supplied air may be relative high at that moment.

Consequently the temperature control employed in the hair dryer of the invention operates under the principle that in the beginning of the drying process the temperature t2 of the supplied air is optimally high but, as the hair becomes drier the temperature falls until the hair is dry or almost dry, whereas during this process the temperature t1 at the head remains constant or almost constant.

In case the person's hair to be treated is dry, this may be signaled in an electrooptical or by another suitable manner. This signal can be used to switch off the heat supply. Consequently an advantage is obtained in that a clock to time the heating processes is not required. Since the person to be treated does not notice that he/she is ready the operator has the opportunity to treat that person at a moment which is most convenient to the operator.

In using the automatic control described herein, the hair-drying process proceeds quickly with maximum comfort to the person to be treated.

It will be obvious that within the scope of the invention other embodiments are possible. As already has been stated the regulating module is of the electronic type but the regulating module can be of any other suitable type.

What is claimed is:

1. An electric hair dryer including a heating source comprising a fan and a heating means, a regulating element connected to said heating means, temperature measuring means for measuring the temperature of the hair being dried and operatively connected to said regulating element in a manner effective to control the amount of power supplied to said heating means and to maintain the hair temperature at a substantially constant level, and an adjusting means connected to said regulating element for adjusting the desired hair-drying temperature.

2. An electric hair dryer according to claim 1, in which said regulating element is connected in the line for supplying adjustable power to said heating means.

3. An electric hair dryer according to claim 1 or 2, in which said regulating element is of the electronic type.

* * * * *